US006474842B2

(12) United States Patent
Shieh

(10) Patent No.: US 6,474,842 B2
(45) Date of Patent: Nov. 5, 2002

(54) DECORATIVE LIGHT ASSEMBLY WITH UPRIGHT ARRANGED LIGHT UNITS

(76) Inventor: Whiter Shieh, 6F, No.245, Tun Hua South Road, Sec. 1, Taipei, 106 (TW)

( * ) Notice: Subject to any disclaimer, the term of this patent is extended or adjusted under 35 U.S.C. 154(b) by 8 days.

(21) Appl. No.: 09/768,046

(22) Filed: Jan. 24, 2001

(65) Prior Publication Data

US 2002/0097580 A1 Jul. 25, 2002

(51) Int. Cl.[7] ..... F21S 13/14

(52) U.S. Cl. ..... 362/252; 362/249; 362/391; 362/396

(58) Field of Search ..... 362/249, 250, 362/252, 391, 396

(56) References Cited

U.S. PATENT DOCUMENTS 4,769,749 A * 9/1988 Felski ..... 362/252

6,305,822 B1 * 10/2001 Lin ..... 362/249

* cited by examiner

*Primary Examiner*—Stephen Husar

(74) *Attorney, Agent, or Firm*—Rosenberg, Klein & Lee

(57) ABSTRACT

A decorative light assembly with a plurality of upright arranged light units is disclosed. The decorative light assembly includes a frame constructed in a first direction. A plurality of light units are electrically connected by a pair of electrical wires and arranged on the frame in a second direction perpendicular to the first direction of the frame. The frame includes a first extended wire and a second extended wire parallel to the first extended wire, therefore forming a long and narrow gap between the first extended wire and the second extended wire. The light mounting member further includes a plastic clipping ring mounted in the central through hole of the light mounting member, and then the light unit is clipped in the central through hole of the plastic clipping ring. Alternatively, the frame is constructed by an extended plate having a plurality of through hole arranged thereon, and the light units are mounted in the through holes of the extended plate.

4 Claims, 6 Drawing Sheets

DECORATIVE LIGHT ASSEMBLY WITH UPRIGHT ARRANGED LIGHT UNITS

BACKGROUND OF THE INVENTION

1. Field of the Invention

The present invention generally relates to a decorative light assembly, and in particular to a decorative light assembly with a plurality of upright arranged light units.

2. Description of the Prior Art

Decorative light assemblies are widely used in holidays and festivals. As shown in FIG. 1, it shows a front elevational view of the prior art decorative light assembly, which is suitable to be hanged or attached on a wall for decoration. The prior art decorative light assembly 10' mainly includes a frame 1' constructed in a first direction I and a plurality of light units 2'. The light units 2' are electrically connected by a pair of electrical wires, forming a decorative light string. Normally, the light units 2' are mounted on the frame 1' substantially in a direction same to the first direction I of the frame 1'. However, it is noted that the decorative light assembly of the prior art has disadvantages of visual disorderliness.

Thus, it is desirable to provide a decorative light assembly with better visual features.

SUMMARY OF THE INVENTION

Accordingly, the primary object of the present invention is to provide a decorative light assembly with a number of light units mounted in a projecting direction perpendicular to the frame of the decorative light assemble, capable of presenting more visible features.

To achieve the above objects, in accordance with the present invention, there is provided a decorative light assembly including a frame constructed in a first direction. A plurality of light units are arranged on the frame in a second direction perpendicular to the first direction of the frame. The frame includes a first extended wire and a second extended wire parallel to the first extended wire, therefore forming a long and narrow gap between the first extended wire and the second extended wire. The light mounting member further includes a plastic clipping ring mounted in the central through hole of the light mounting member, and then the light unit is clipped in the central through hole of the plastic clipping ring. Alternatively, the frame is constructed by an extended plate having a plurality of through hole arranged thereon, and the light units are mounted in the through holes of the extended plate.

Further, the decorative light assembly may be composed of a frame constructed in a first direction, and a plurality of light units electrically connected by a pair of electrical wires. Each of the light units is provided with at least a side clipper to clip the light units onto the frame in a second direction perpendicular to the first direction of the frame.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
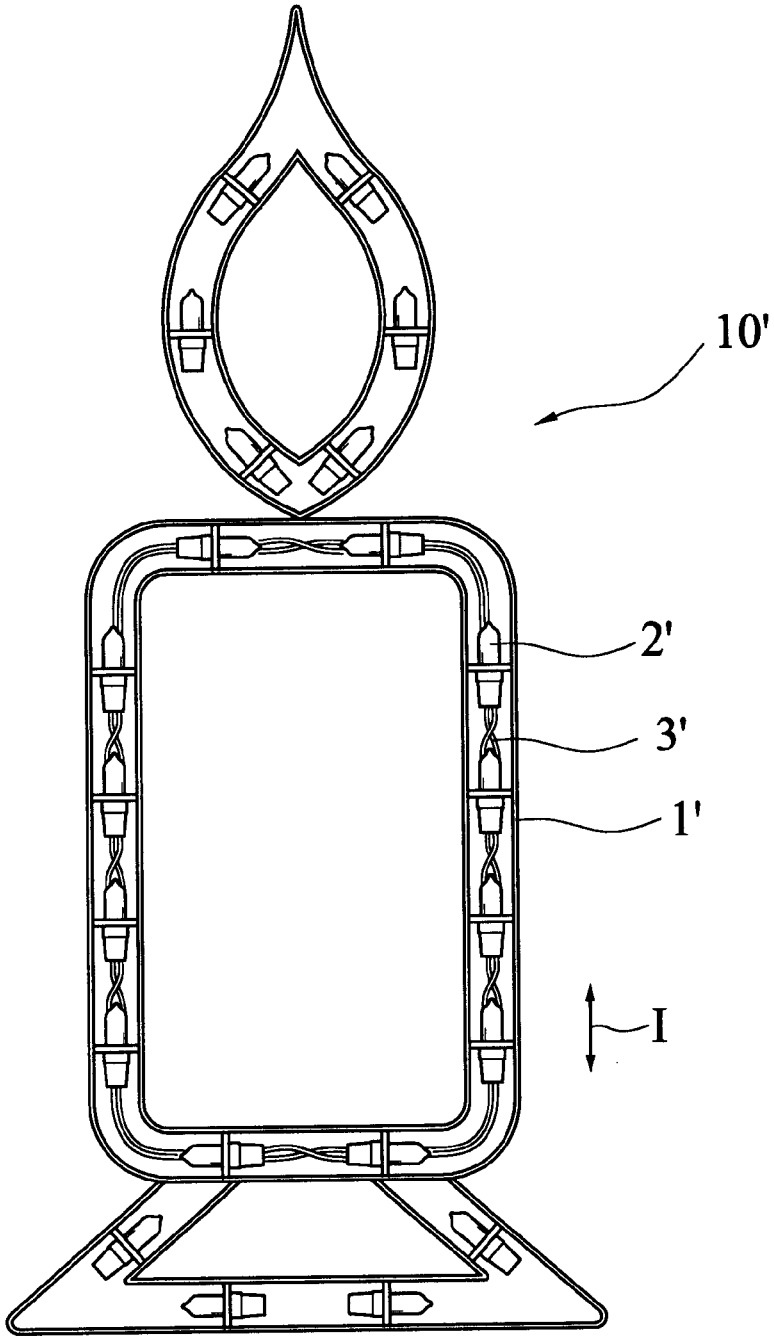
FIG. 1 (Prior Art)
FIG. 1 is a front elevational view of the prior art decorative light assembly.
Figure 2:
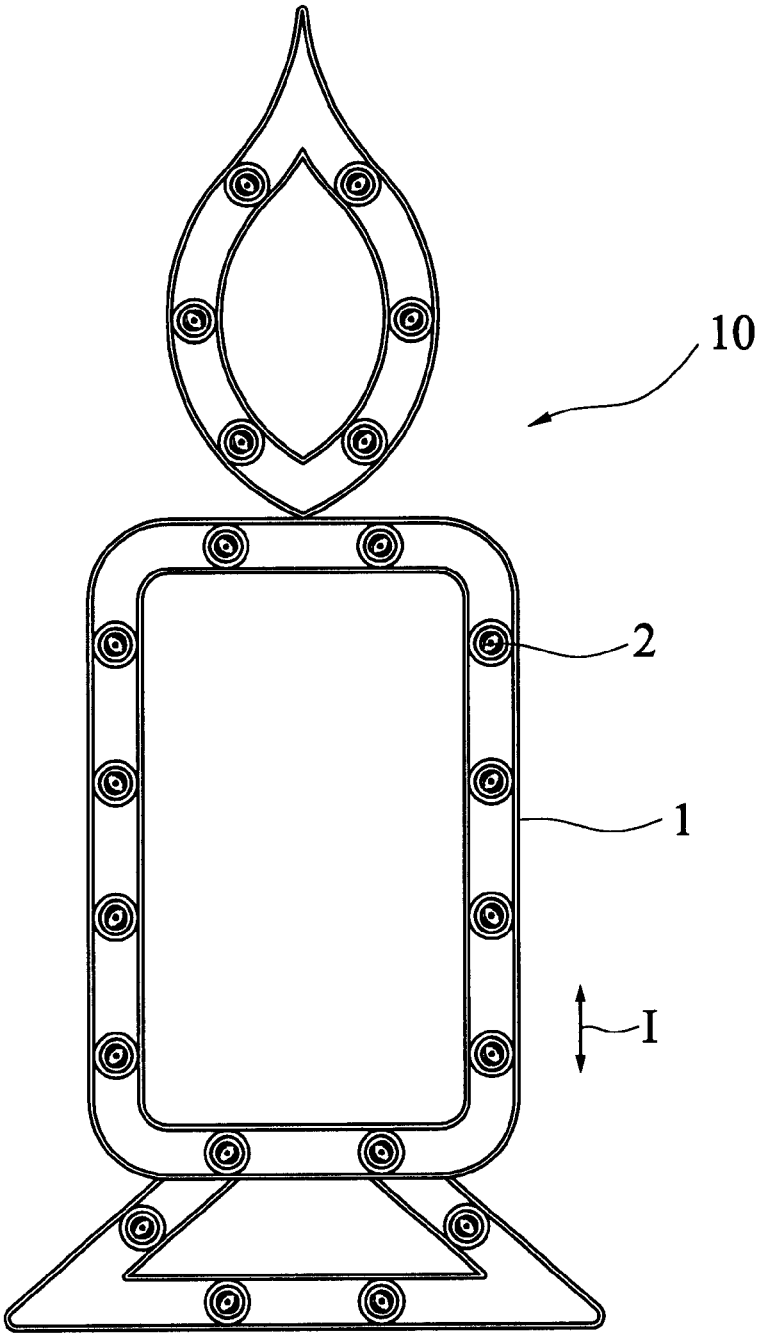
FIG. 2 is a front elevational view of the decorative light assembly of the present invention.

With reference to FIG. 2, a decorative light assembly constructed in accordance with the present invention, generally designated with reference numeral 10, is shown. The decorative light assembly 10 of the present invention includes a frame 1 constructed in a first direction I. A plurality of light units are arranged on the frame 1 in a second direction II which is perpendicular to the first direction I of the frame.

Figure 3:
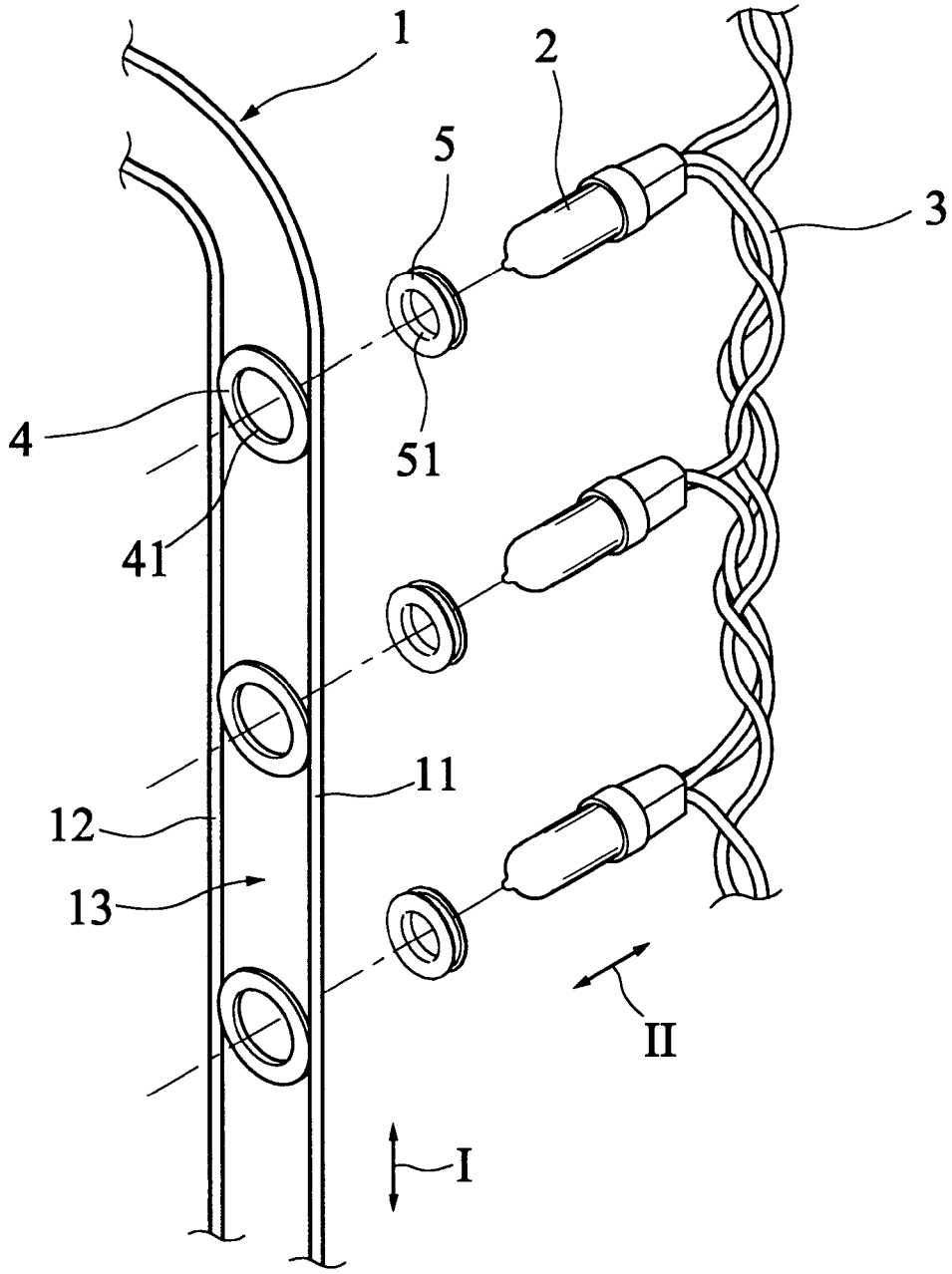
FIG. 3 is a perspective view of the decorative light assembly, showing a number of light units are mounted on a frame in accordance with a first embodiment of the present invention.

FIG. 3 is a perspective view of the decorative light assembly 10, showing the light units 2 may be mounted on the frame 1 in accordance with a first embodiment of the present invention. In this embodiment, the frame 1 is composed of a first extended wire 11 and a second extended wire 12, constructed in a first direction I. The second extended wire 12 is parallel to the first extended wire 11, therefore forming a long and narrow gap 13 between the first extended wire 11 and the second extended wire 12. Each of the light units 2 is electrically connected by a pair of electrical wires 3 forming a decorative light string and then connected to an electric power source.

A plurality of light mounting members 4 are securely arranged in the gap 13 formed between the first extended wire 11 and the second extended wire 12. Each of the light mounting members 4 is provided with a central through hole 41.

Further, the present invention includes a number of plastic clipping rings 5. Each of the plastic clipping rings 5 is provided with a central through hole 51. The plastic clipping ring 5 is made of, for example, rubber material, and is adapted to be mounted in the central through hole 41 of the light mounting member 4. So, the light unit 2 may be mounted onto the frame 1 by means of the plastic clipping ring 5. Particularly, the light units 2 are arranged on the frame 1 in a second direction II which is perpendicular to the first direction I of the frame.

Figure 4:
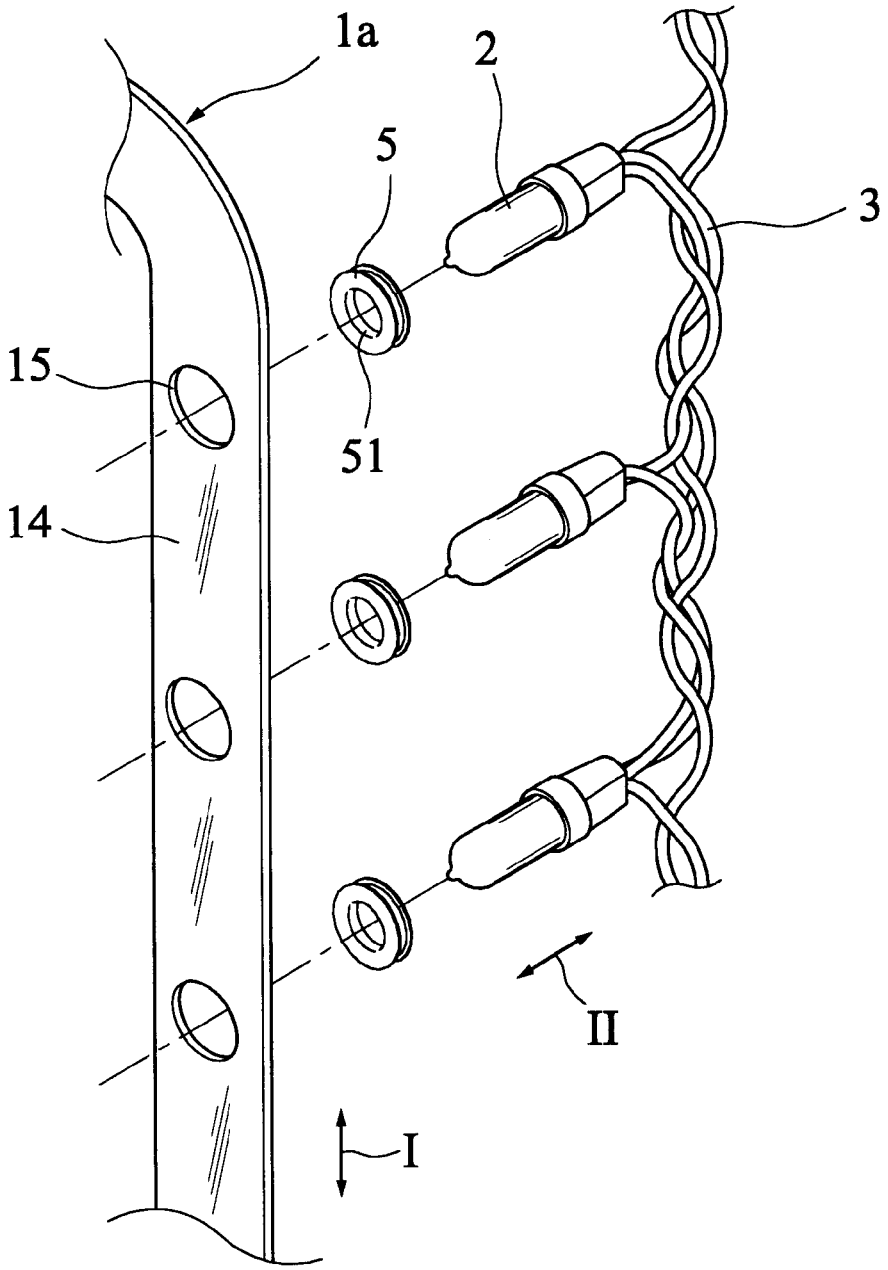
FIG. 4 is a perspective view of the decorative light assembly, showing a number of light units are mounted on a frame in accordance with a second embodiment of the present invention.

FIG. 4 is a perspective view of the decorative light assembly, showing the light units may be mounted on the frame in accordance with a second embodiment of the present invention. For explanation, the same reference numbers used in the previous drawing will be used to refer to the same or like parts. In this embodiment, the frame 1*a* is in a form of extended plate 14 constructed in a first direction I. The extended plate 14 is provided with a number of through holes 15 arranged thereon.

Similar to the first embodiment of the present invention as shown in FIG. 3, a number of plastic clipping rings 5 provided with a central through hole 51 may be mounted in the through hole 15 of the extended plate 14. So, the light unit 2 may be mounted onto the frame 1*a* by means of the plastic clipping ring 5. Particularly, the light units 2 are arranged on the frame 1*a* in a second direction II which is perpendicular to the first direction I of the frame 1*a*.

Figure 5:
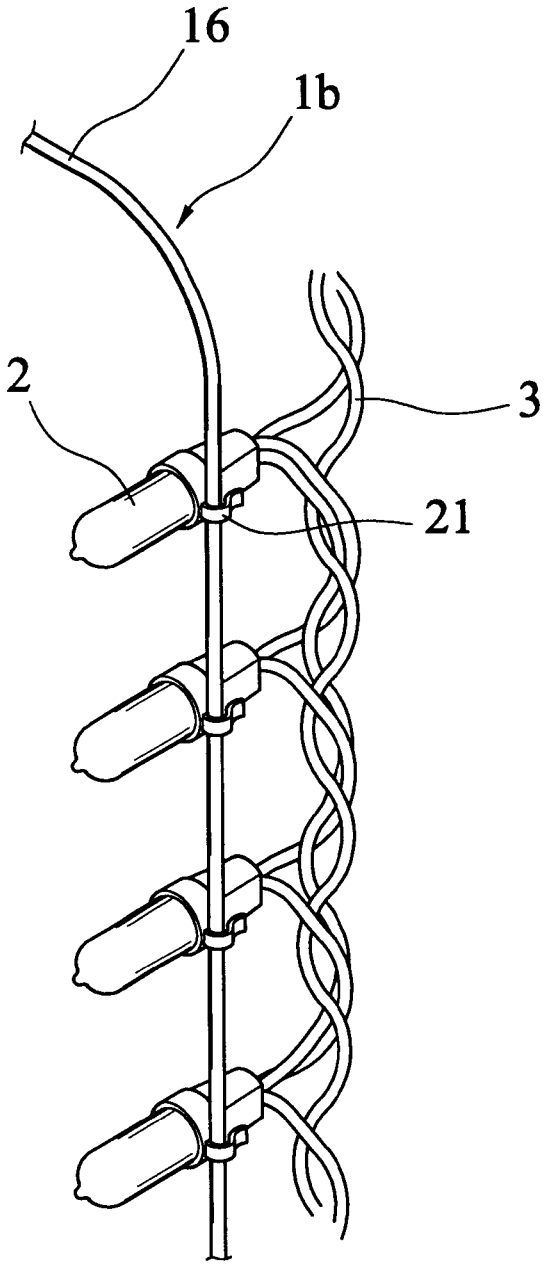
FIG. 5 is a perspective view of the decorative light assembly, showing a number of light units are mounted on a frame in accordance with a third embodiment of the present invention.

FIG. 5 is a perspective view of the decorative light assembly, showing the light units may be mounted on the frame in accordance with a third embodiment of the present invention. In this embodiment, the frame 1*c* includes an extended wire 16 constructed in a first direction I.

A plurality of light units 2 electrically connected by a pair of electrical wires 3 forming a decorative light string. Each of the light units 2 is provided with a side clipper 21 to clip the light units 2 onto the frame 1*b* in a second direction II perpendicular to the first direction I of the frame 1*b*.

Figure 6:
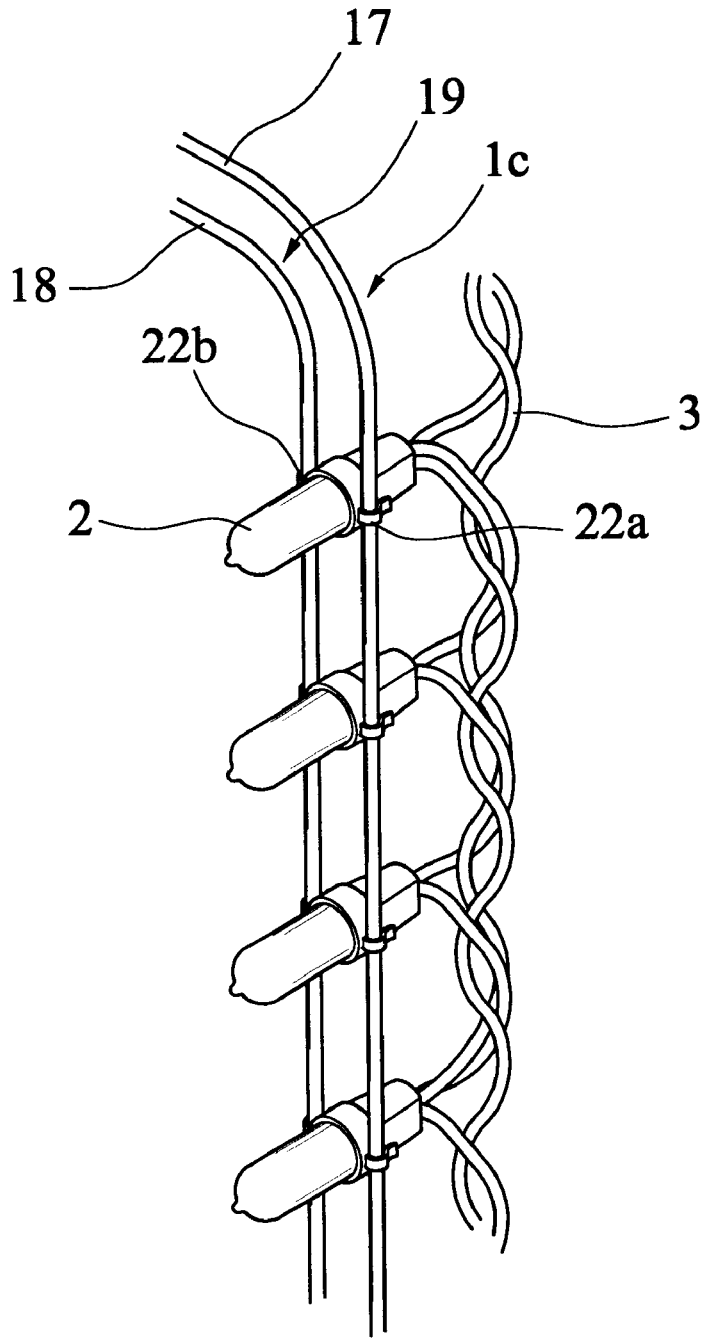
FIG. 6 is a perspective view of the decorative light assembly, showing a number of light units are mounted on a frame in accordance with a fourth embodiment of the present invention.

FIG. 6 is a perspective view of the decorative light assembly, showing the light units may be mounted on the frame in accordance with a fourth embodiment of the present invention. In this embodiment, the frame 1*c* is composed of a first extended wire 17 and a second extended wire 18, constructed in a first direction I. The second extended wire 18 is parallel to the first extended wire 17, therefore forming a long and narrow gap 19 between the first extended wire 17 and the second extended wire 18.

Each of the light units 2 is provided with a pair of side clippers 22*a* and 22*b* to clip the light units 2 onto the extended wires 17 and 18 in a second direction II perpendicular to the first direction I of the frame 1*c*.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A decorative light assembly, comprising:

a frame constructed in a first direction;

a plurality of light mounting members fixedly secured on said frame, each of said light mounting members having a central opening;

a plurality of clipping rings, each of said clipping rings having a central through hole formed therein, said plurality of clipping rings being respectively mounted in said openings of said plurality of light mounting members; and, a plurality of light units electrically connected by a pair of electrical wires, said plurality of light units being respectively mounted in said central through holes of said plurality of clipping rings in a second direction, said second direction being perpendicular to said first direction of the frame.

2. The decorative light assembly as claimed in claim 1, wherein the frame comprises:

a first extended wire; and a second extended wire parallel to the first extended wire, therefore forming a long and narrow gap between the first extended wire and the second extended wire.

3. A decorative light assembly, comprising:

a frame constructed in a first direction, said frame including an extended plate having a plurality of through holes formed therein;

a plurality of clipping rings, each of said clipping rings having a central through hole formed therein, said plurality of clipping rings being respectively mounted in said plurality of through holes of said extended plate; and, a plurality of light units electrically connected by a pair of electrical wires, said plurality of light units being respectively mounted in said central through holes of said plurality of clipping rings in a second direction, said second direction being perpendicular to said first direction of the frame.

4. A decorative light assembly, comprising:

a frame constructed in a first direction, said frame including a pair of wires extending in said first direction in parallel relationship, said pair of wires being spaced one from the other by a predetermined gap; and a plurality of light units electrically connected by a pair of electrical wires, each of said light units being provided with at least one side clipper to couple said light unit to said frame in a second direction, said second direction being perpendicular to said first direction of the frame.

* * * * *